US005333590A

United States Patent [19]

Thomson

[11] Patent Number: 5,333,590

[45] Date of Patent: Aug. 2, 1994

[54] DIAGNOSTIC SYSTEM FOR CANISTER PURGE SYSTEM

[75] Inventor: Jon Thomson, Jackson, Mich.

[73] Assignee: Pilot Industries, Inc., Dexter, Mich.

[21] Appl. No.: 55,662

[22] Filed: Apr. 26, 1993

[51] Int. Cl.[5] ..... F02M 33/02

[52] U.S. Cl. ..... 123/520; 123/198 D

[58] Field of Search ..... 123/516, 518, 519, 520, 123/521, 198 D

[56] References Cited

U.S. PATENT DOCUMENTS

| | | | |
|---|---|---|---|
| 4,497,290 | 2/1985 | Harris . | |
| 4,575,807 | 3/1986 | Dodge . | |
| 4,852,054 | 7/1989 | Mastandrea . | |
| 4,862,731 | 9/1989 | Gates . | |
| 4,949,695 | 8/1990 | Uranishi et al. . | |
| 4,962,744 | 10/1990 | Uranishi et al. . | |
| 5,022,364 | 6/1991 | Phillips . | |
| 5,042,290 | 8/1991 | Geisinger . | |
| 5,065,350 | 11/1991 | Fedder . | |
| 5,078,006 | 1/1992 | Maresca, Jr. et al. . | |
| 5,085,197 | 2/1992 | Mader et al. . | |
| 5,105,789 | 4/1992 | Aramaki | 123/520 |
| 5,143,035 | 9/1992 | Kayanuma . | |
| 5,146,902 | 9/1992 | Cook et al. | 123/520 |
| 5,178,117 | 1/1993 | Fijimoto et al. | 123/520 |
| 5,186,153 | 2/1993 | Steinbrenner et al. | 123/520 |
| 5,188,085 | 2/1993 | Habaguchi et al. | 123/520 |
| 5,191,870 | 3/1993 | Cook . | |
| 5,193,512 | 3/1993 | Steinbrenner et al. . | |
| 5,216,995 | 6/1993 | Hosoda et al. | 123/520 |
| 5,220,896 | 6/1993 | Blumenstock et al. . | |
| 5,220,898 | 6/1993 | Kidokoro et al. . | |
| 5,230,319 | 7/1993 | Otsuka et al. | 123/520 |
| 5,237,979 | 8/1993 | Hyodo et al. | 123/520 |
| 5,243,944 | 9/1943 | Blumenstock | 123/520 |
| 5,261,379 | 11/1993 | Lipinski et al. | 123/198 D |
| 5,263,462 | 11/1993 | Reddy | 123/198 D |

*Primary Examiner*—E. Rollins Cross
*Assistant Examiner*—Thomas N. Moulis
*Attorney, Agent, or Firm*—Gifford, Groh, Sprinkle, Patmore and Anderson

[57] ABSTRACT

The present invention provides a system for detecting leaks in the evaporative emission control system utilized in automotive vehicles. Such control systems include a carbon filled canister having both a vent port and a fuel vapor port. The fuel vapor port, as well as a vapor line from the fuel tank, are connected through a purge valve to the intake manifold of the internal combustion engine. The present invention includes a vent valve which is fluidly connected with the canister vent port. An electronic control system closes both the vent valve and opens the purge valve thereby exposing the evaporative emission control system to the partial vacuum in the intake manifold. After a predetermined time period, the purge valve is closed thus entrapping the partial vacuum in the purge system while a pressure transducer thereafter monitors the partial vacuum in the purge system. Changes in the partial vacuum over a time period, after correction by extraneous factors such as temperature and fuel volume in the fuel tank, greater than a threshold amount indicates a leak in the evaporative emission system. When this occurs, the system generates a fault signal to alert the vehicle operator of the leak.

13 Claims, 2 Drawing Sheets

DIAGNOSTIC SYSTEM FOR CANISTER PURGE SYSTEM

BACKGROUND OF THE INVENTION

I. Field of the Invention

The present invention relates to a diagnostic system for detecting leaks in the evaporative emission control system of the type used in automotive vehicles.

II. Description of the Prior Art

Government regulations require that automotive vehicles be equipped with an evaporative emission control system in order to prevent, or at least minimize, the release of volatile fuel vapors to the atmosphere. Such systems typically comprise a carbon filled canister having both a vent port and a fuel vapor port. The fuel vapor port is connected to a vapor line open to the fuel tank head space so that fuel vapors from the fuel tank are adsorbed by the carbon in the canister.

Additionally, the canister vapor port together with the vapor line from the fuel tank are connected through a purge valve to the intake manifold of the engine. The purge valve is typically solenoid operated and is controlled by the on board computer for the engine. In operation, during certain engine conditions which are preprogrammed into the on board computer, the on board computer opens the purge valve and allows the vacuum from the intake manifold to induct vapors which have previously been adsorbed by the carbon in the carbon canister. Such inducted vapors are, of course, combusted in the engine in the desired fashion.

U.S. governmental regulations require that certain future automobiles be equipped with on board diagnostic capability for determining if a leak is present in the evaporative emission control system for the vehicle. In particular, leaks in the evaporative emission control system greater than a preset amount, for example 0.04 inches in diameter, must be detected and reported to the vehicle operator.

There are a number of previously known proposed systems for detecting leaks in the evaporative emission control system. These previously known systems, however, require relatively expensive additional engine components which unduly increase the overall cost of the leak diagnostic system.

SUMMARY OF THE PRESENT INVENTION

The present invention provides a diagnostic system for detecting leaks in the evaporative emission control system of the automotive vehicle which overcomes all of the previously known disadvantages of the prior devices.

In brief, the present invention comprises a valve assembly having three solenoid operated valves. The first valve is a canister vent valve which is fluidly connected in series with the vent port from the carbon canister.

The second valve is a bypass valve in series between the tank and canister which, during normal operation, operates to limit the rate of evaporation of the fuel. Actuation of the bypass valve, however, bypasses the device thus providing pressure equalization through the evaporative emission control system.

The final valve is a canister purge valve which is fluidly connected in series between the vapor port for the carbon canister and the intake manifold. When opened, the partial vacuum in the intake manifold is fluidly connected with the evaporative emission control system which, during normal operation, inducts vapors collected in the carbon canister into the intake manifold for combustion in the engine.

The present system further includes a pressure transducer and a temperature transducer which are positioned in the fuel tank and preferably at the fuel sending unit. Both transducers provide input signals to an on board computer unit (ECU). The ECU, in turn, provides output signals to selectively operate the valves in the valve assembly as well as perform other control functions for the engine.

In operation, during a diagnostic test, the ECU first generates output signals to close the canister vent valve and open both the purge valve and the bypass valve. At the same time, the ECU initiates a timer. With the canister vent valve closed and the bypass valve and purge valve opened, the evaporative emission control system is exposed to the partial vacuum from the intake manifold of the engine.

The ECU iteratively reads the signal from the pressure transducer in the fuel tank. In the event that the pressure is greater than predetermined amount at the end of a predetermined timer period, i.e. a prdetermined vacuum threshold, a gross leak is indicated. In this case, the ECU generates an appropriate fault signal to provide an indication of the malfunction to the vehicle operator.

Assuming that the vacuum is below a predetermined pressure, i.e. vacuum, threshold, the ECU next closes the purge valve which entraps the vacuum imposed by the intake manifold in the evaporative emission control system. After a predetermined delay to allow vacuum equalization, the ECU monitors the pressure transducer and, after reading the appropriate signals from the temperature transducer and the fuel level transducer, calculates the droop rate for the vacuum in the evaporative emission control system. If the droop rate is within preset limits, indicative of a no leak condition, the ECU resets the valves to their initial position and returns. Otherwise, the ECU generates a fault signal and warns the vehicle operator of a malfunction in the evaporative emission control system.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
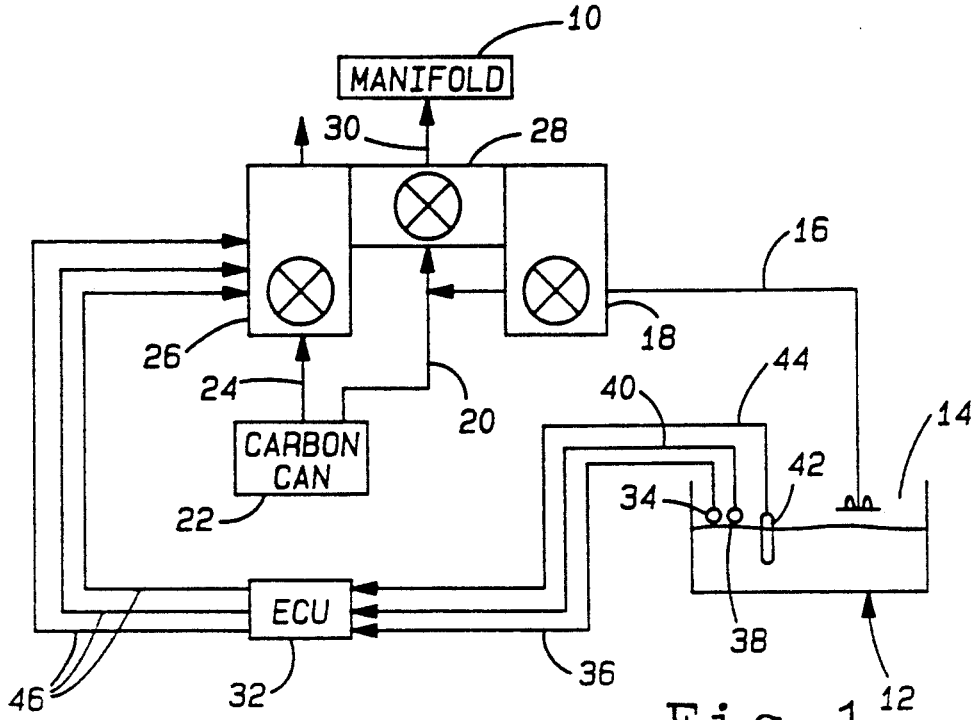
FIG. 1 is a diagrammatic view illustrating a preferred embodiment of the present invention.

With reference first to FIG. 1, a diagrammatic view of the present invention is thereshown for use with an evaporative emission control system for an automotive vehicle. The vehicle includes an intake manifold 10 and a fuel tank 12. The head space 14 for the fuel tank 12 is fluidly connected by a line 16 through a bypass valve 18 to a vapor port 20 of a carbon filled canister 22. The canister 22 also includes a vent port 24 which is fluidly connected via a vent valve 26 to atmosphere. The vapor port 20 from the carbon canister 22 is also connected through a canister purge valve 28 to the intake manifold 10 through a fluid line 30.

During normal operation, the vent valve 26 is open and the purge valve 28 is modulated by the ECU. The bypass valve 18 comprises a device which acts to reduce evaporation of the fuel by raising the head space pressure. Alternatively, an orifice can be used to reduce evaporation.

An electronic control unit (ECU) 32 controls the operations of the valves 26, 28 and 18 as well as performs other control functions for the engine. During a canister purge operation, the ECU 32 generates a signal to the purge valve 28 to open the purge valve 28. In doing so, the intake manifold 10 inducts the vapors entrapped within the carbon canister 22 by inducting fresh air through canister vent 24, through the canister and into the intake manifold 10 for combustion in the engine.

The present invention provides a diagnostic system for detecting leaks within the evaporative emission control system. This system includes a pressure transducer 34 in the fuel tank head space 14 which generates an output signal on line 36 to the ECU 32 representative of the pressure (including vacuum) in the fuel tank head space 14. Similarly, a temperature transducer 38 in the fuel tank 12 generates an output signal on line 40 to the ECU 32 representative of the temperature while a fuel level transducer 42 also provides a signal on line 44 to the ECU 32 indicative of a level of fuel in the fuel tank 12. Preferably, both the pressure transducer 34, temperature transducer 38 and fuel level transducer 42 can be constructed as part of the fuel sending unit and installed as a single unit in the fuel tank 12.

The vent valve 26, purge valve 28 and fuel tank pressure control valve 18 are all preferably constructed as a single valve assembly for low cost construction. Additionally, each valve 26, 28 and 18 is solenoid operated and is controlled by output signals on lines 46 from the ECU 32. For example, during a conventional canister purge operation, the ECU 32 generates an output signal on line 46 which opens the purge valve 28 and allows the vacuum from the intake manifold 10 to evacuate fuel vapors from the carbon canister 22.

Figure 2:
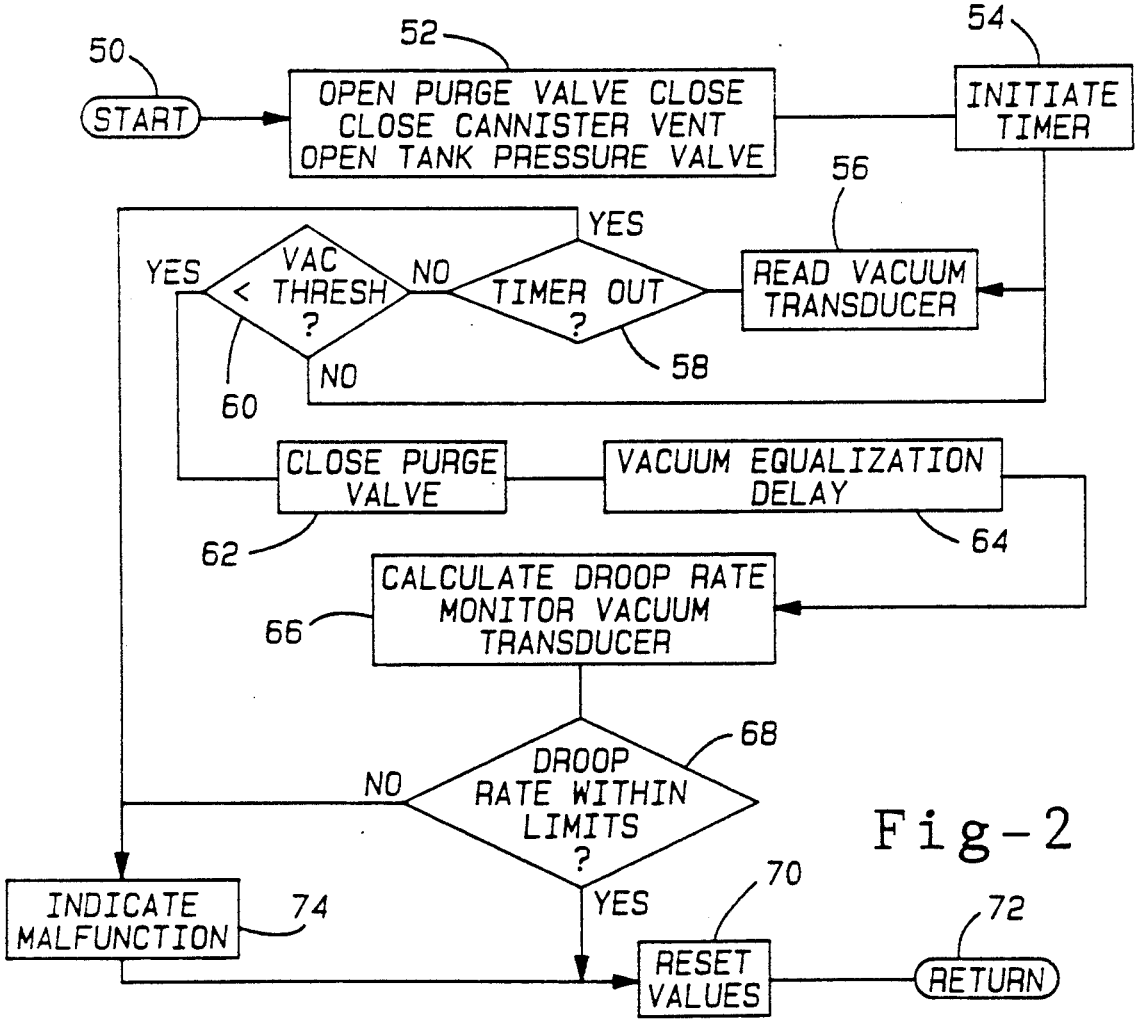
FIG. 2 is a flow chart illustrating the operation of the preferred embodiment of the present invention.

With reference now to FIG. 2, an algorithm for performing a diagnostic test to determine leaks in the evaporative emission control system is thereshown. The ECU 32 initiates the test at step 50 only when certain engine operating conditions are present. Such engine operating conditions require that a vacuum be present in the intake manifold 10, such as, for example, when the engine is in an idling condition.

Once the diagnostic test is initiated, step 50 branches to step 52. At step 52, the ECU 32 generates output signals on its lines 46 to open the purge valve 28, close the canister vent valve 26 and open the bypass valve 18. In doing so, the evaporative emission control system is fuidly connected to the vacuum from the intake manifold 10. Step 52 then branches to step 54.

At step 54, the ECU 32 initiates an internal timer having a preset time period, e.g. ten seconds, and then branches to step 56.

At step 56, the ECU reads the pressure transducer 34 and then branches to step 58 which determines if the timer has not run out, step 58 branches to step 60 which detemines if the vacuum has fallen below a predetermined threshold amount. If not, step 60 branches to step 56 and the above process is repeated. Conversely, if the vacuum is below a predetermined thershold, step 60 branches to step 62.

Steps 54, 56, 58 and 60 all determine if a gross leak is present in the evaporative emission control system. If a gross leak is present, the vacuum will not fall below the threshold value at step 60 so that step 60 will continuously branch back to step 56. Ultimately, the timer will run out whereupon step 58 branches to step 74 where the ECU generates an appropriate warning signal to the driver warning the driver of a malfunction in the evaporative emission control system.

Assuming that a gross leak is not present within the evaporative emission control system, step 60 branches to step 62 where the ECU 32 generates appropriate signals on its output lines 46 to close the purge valve 28. In doing so, the vacuum created by the intake manifold 10 is entrapped within the evaporative emission control system. Step 62 then branches to step 64.

At step 64, the ECU 32 imposes a preset delay to allow equalization of the vacuum in the evaporative emission control system. Step 64 then branches to step 66.

At step 66, the ECU 32 monitors both the pressure transducer 34, temperature transducer 38 and fuel level transducer 42 and calculates the droop rate of the vacuum in the evaporative emission control system. The droop rate is calculated over a period of time, for example forty seconds. The droop rate is preferably calculated in accordance with the following formula:

$$R1=((Dp-Edt)-Erup)*Vv$$

where

R1 equals the leakage threshold value

Dp=pressure change

Edt=effect of temperature change

Erup=effect of evaporation of fuel

Vv=vapor volume.

By calculating the droop rate in the above described fashion, changes in temperature, variations in fuel level height in the fuel tank, and the like can be compensated in order to accurately detect leaks in the evaporative emission control system.

After the droop rate is monitored at step 66, step 66 branches to step 68 which determines if the droop rate falls within acceptable limits. If not, step 68 branches to step 74 which, as before, provides an appropriate alert signal to the vehicle operator. Otherwise step 68 branches to step 70 which resets the valves 26, 18 and 28 to their initial value. Step 70 then branches to step 72 and returns from the routine.

Figure 3:
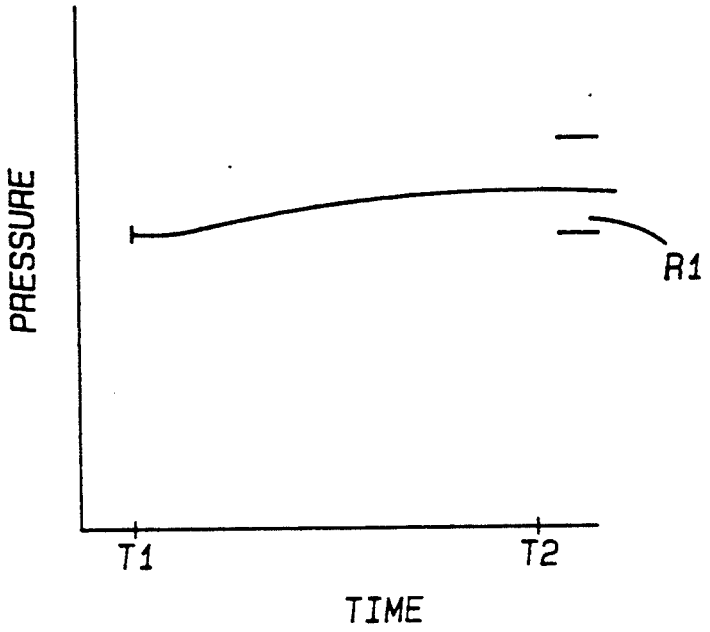
FIG. 3 is a graph illustrating pressure versus time for a diagnostic test in which no leak is present.

With reference now to FIG. 3, a graph of pressure versus time is thereshown in which the diagnostic test initiated at time T1 and terminating at time T2. The pressure (after correction for any temperature changes) is plotted as a function of time. In the FIG. 3 graph, the pressure drop is within the acceptable leakage rate R1 indicating that no unacceptable leaks are present in the system.

Figure 4:
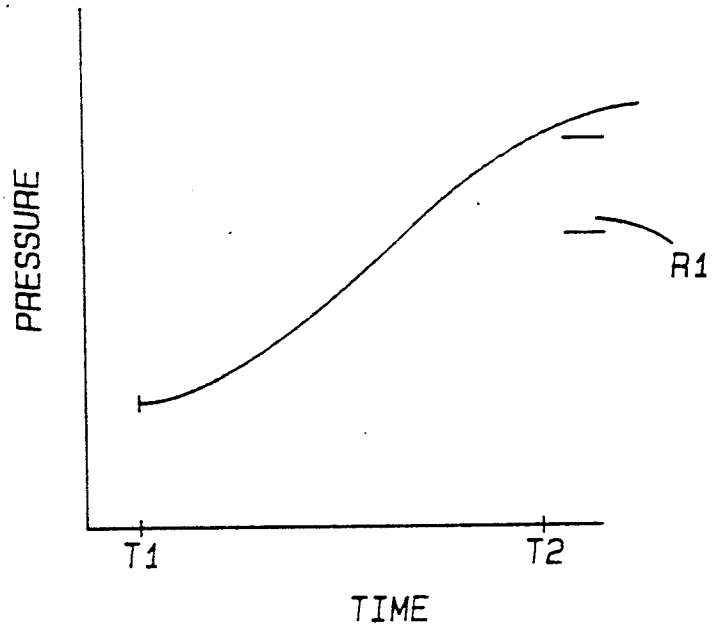
FIG. 4 is a graph similar to FIG. 3 but illustrating when a leak is present.

Conversely, with reference to FIG. 4, a diagnostic test of pressure versus time is thereshown for a diagnostic test initiated at time T1 and terminating at time T2. In this case, an unacceptable leak is present within the system so that the drop in vacuum (or increase in pressure) during the test exceeds the acceptable amount $R_1$. In this case, the ECU provides the appropriate alert signals to the vehicle operator.

From the foregoing, it can be seen that the present invention provides a simple and yet inexpensive diagnostic system for the evaporative emission control system of an automotive vehicle.

Having described my invention, however, many modifications thereto will become apparent to those skilled in the art to which it pertains without deviation from the spirit of the invention as defined by the scope of the appended claims.

I claim:

1. For use in conjunction with a fuel system for an internal combustion engine having an intake manifold, a fuel tank and an evaporative emission control system, said evaporative emission control system having a fuel vapor canister having a vent port and a vapor port and a canister purge valve fluidly connected between said canister vapor port and said intake manifold, a system for detecting leaks in the evaporative emission control system comprising;

a vent valve fluidly connected in series with the canister vent port, means for closing said vent valve and opening said purge valve to thereby create a partial vacuum in said purge system, means for measuring said partial vacuum in said purge system, means for generating a fault signal when the change in the partial pressure after said closure of said purge valve exceeds a leakage threshold value over a predetermined time period, means for measuring the temperature of fluid in the purge system, means for measuring the volume of liquid in the fuel tank, wherein the leakage threshold value is a function of the vacuum droop rate of the purge system and is calculated in accordance with the following equation:

$$R1=((Dp-Edt)-Erup)*Vv$$

where

R1 equals the leakage threshold value

Dp=pressure change

Edt=effect of temperature change

Erup=effect of evaporation of fuel

Vv-vapor volume.

2. The invention as defined in claim 1 and comprising means for opening said vent valve and said purge valve after said predetermined time period.

3. The invention as defined in claim 1 wherein said partial vacuum measuring means comprises a pressure transducer.

4. The invention as defined in claim 3 wherein said pressure transducer is fluidly connected to a head space in said fuel tank.

5. The invention as defined in claim 1 and comprising a bypass valve fluidly connected in series between said fuel tank and said canister, and means for opening said bypass valve during said predetermined time period.

6. The invention as defined in claim 5 wherein said purge valve, said bypass valve and said vent valve are each electrically actuated.

7. The invention as defined in claim 6 wherein said purge valve, said bypass valve and said vent valve are each contained in a common housing.

8. The invention as defined in claim 1 and comprising means for monitoring the temperature of the purge system.

9. The invention as defined in claim 8 wherein said temperature monitoring means comprises a temperature transducer positioned in said fuel tank.

10. For use in conjunction with a fuel system for an internal combustion engine having an intake manifold, a fuel tank and an evaporative emission control system, said evaporative emission control system comprising a fuel vapor canister having a vent port and a vapor port, a canister purge valve fluidly connected between said canister vapor port and said intake manifold and a vent valve fluidly connected in series with the canister vent port, a method for detecting leaks in the evaporative emission system comprising:

closing said vent valve and opening said purge valve to thereby create a partial vacuum in said purge system, measuring said partial vacuum in said purge system, generating a fault signal when the change in the partial pressure after said closure of said purge valve exceeds a leakage threshold value over a predetermined time period, wherein the leakage threshold value is a function of the vacuum droop rate of the purge system and is calculated in accordance with the following equation:

$$R1=((Dp-Edt)-Erup)*Vv$$

where

R1 equals the leakage threshold value

Dp=pressure change

Edt=effect of temperature change

Erup=effect of evaporation of fuel

Vv=vapor volume.

11. The invention as defined in claim 10 and further comprising the step of measuring the fluid temperature in the purge system during said predetermined time period.

12. The invention as defined in claim 10 and further comprising the step of allowing the partial vacuum to equalize for a preset time period after closure of the purge valve and prior to measuring the partial vacuum.

13. The invention as defined in claim 10 and further comprising the step of imposing a preset time delay after said purge valve closing step and prior to said partial vacuum measuring step.

* * * * *